United States Patent [19]

Lueth

[11] Patent Number: 4,591,481

[45] **Date of Patent: * May 27, 1986**

[54] METALLURGICAL PROCESS

[75] Inventor: Roy C. Lueth, Mt. Clemens, Mich.

[73] Assignee: Ultra-Temp Corporation, Mt. Clemens, Mich.

[ * ] Notice: The portion of the term of this patent subsequent to Feb. 14, 2001 has been disclaimed.

[21] Appl. No.: 690,935

[22] Filed: Jan. 14, 1985

Related U.S. Application Data

[63] Continuation-in-part of Ser. No. 535,278, Sep. 23, 1983, which is a continuation-in-part of Ser. No. 375,681, May 6, 1982, Pat. No. 4,431,605.

[51] Int. Cl.[4] ..... B22F 3/00

[52] U.S. Cl. ..... 419/26; 419/28; 419/36; 419/37; 419/47; 419/48; 419/57; 419/60; 75/228; 75/236

[58] Field of Search ..... 419/26, 28, 36, 37, 419/47, 48, 57, 60; 75/228, 236

[56] References Cited

U.S. PATENT DOCUMENTS

| | | | |
|---|---|---|---|
| Re. 31,355 | 8/1983 | Rozmus | 419/48 |
| 3,469,976 | 9/1969 | Iler | 75/204 |
| 4,063,940 | 12/1977 | James | 419/60 |
| 4,142,888 | 3/1979 | Rozmus | 419/48 |
| 4,431,605 | 2/1984 | Lueth | 419/26 |

*Primary Examiner*—Stephen J. Lechert, Jr.
*Attorney, Agent, or Firm*—Gifford, Van Ophem, Sheridan, Sprinkle & Nabozny

[57] ABSTRACT

The present invention discloses a method for densifying previously sintered parts constructed of powdered metals, ceramics or the like to nearly 100% theoretical density. The method of the present invention comprises heating the parts containing binder and hard phase above their liquid phase temperature and then applying a pressure in a predetermined range to the parts for a predetermined period of time and simultaneously maintaining the parts at or above their liquid phase temperature. This pressure range is set so that the pressure is below the pressure necessary to overcome the capillary force acting on the binder to keep the binder from entering the voids but above the pressure necessary to physically move or collapse the microstructure inwardly, thus filling the voids with a homogenous mixture of binder and hard phase. The method of the present invention achieves complete closure of even large voids and the elimination of substantially all porosity within the part.

6 Claims, 17 Drawing Figures

METALLURGICAL PROCESS

CROSS REFERENCE TO RELATED APPLICATIONS

This application is a continuation in part of U.S. patent application Ser. No. 535,278, filed Sept. 23, 1983, entitled METALLURGICAL PROCESS, which was a continuation in part of U.S. patent application Ser. No. 375,681 entitled METALLURGICAL PROCESS, filed May 6, 1982 and now U.S. Pat. No. 4,431,605.

BACKGROUND OF THE INVENTION

I. Field of the Invention

The present invention relates to a method for densifying previously sintered parts of powdered metals, ceramics, hard metals and the like which are sintered in the presence of a liquid phase.

II. Description of the Prior Art

In the liquid phase of sintering powdered metals, ceramics, hard metals and the like, the powdered material which may comprise a powdered hard phase and powdered metal binder, is first intermixed with a fugitive binder which holds the part in the desired shape after cold pressing. Usually this fugitive binder consists of paraffin, polyethelene glycol, or a metal containing hydrocarbon or other organic plasticizer. The cold pressed part is conventionally known as a preform.

The preforms are then subjected to a presintering step in which the preforms are slowly heated, thus vaporizing the fugitive binder and the vaporized binder is removed from the part by a wash gas, vacuum pumping or other means. Following the presintering step, the parts retain their shape due to some solid state sintering of the powdered binder.

The parts are then subjected to a sintering operation in which the parts are raised to a temperature where some liquid phase appears and some solutioning of the hard phase occurs. This appearance of the liquid phase relatively rapidly densifies the part due to capillary action and solutioning effects. Following the sintering of the parts, the parts are sufficiently dense and hard for many applications.

In the WC-Co system, these sintering parts comprise hard phase paticles such as tungsten carbide, held together by a binder such as cobalt. Following the sintering process, the parts may contain voids surrounded by a mix of hard particles and binder in which the hard phase particles are spaced from each other by a distance less than the width of the void size.

For applications requiring still further densification, greater strength of the sintered part or better internal integrity, the parts may be further treated. Several types of treatments to accomplish this reduction in porosity are known in the prior art.

All of the previously described methods, although effective in reducing porosity and/or voids, suffer from problems in effectively producing a homogenous structure free from stress risers or internal stresses which can be detrimental to the performance of the material.

WC-Co alloys are ternary in nature due to the three constituents involved; mainly tungsten, carbon and cobalt. Because of this when the solidus or eutectic temperature is reached, all of the binder does not melt but rather this melting occurs over a range of temperatures. Also, some amount of solutioning of the WC occurs as the temperature is increased which may decrease the amount of solid remaining and increase the amount of liquid. The amount of liquid present at any given temperature in the three phase region where melting occurs, is very dependent on the exact composition of the WC-Co alloy under consideration.

FIG. 17 shows a vertical quasi-binary section of the WC-Co ternary phase diagram parallel to the C-W binary at 16% Co. This figure is from a paper by J. Gurland—Journal of Metals 6,285,1327 (1957). Similar phase diagrams will apply to other hard metals.

For WC-Co alloys to perform properly, they must avoid free carbon or carbon deficient phases in the microstructure. FIG. 17 shows that the useful area for WC-Co alloy of 16% cobalt is the WC+$\gamma$ field which ranges from 6.00–6.13 wt. % carbon. ($\gamma$ represents solid binder). A typical 16% WC-Co alloy would contain carbon in this range. When sintering such an alloy, some liquid phase should be present and this can be obtained in the WC+$\gamma$+Liq field or in the WC+Liq field, i.e. all binder ($\gamma$) has dissolved in the latter case. This would preferably be in the WC+Liq field as this would give the largest possible amount of liquid. The temperature at which the WC+liquid field is entered however, ranges from 1360° C. to 1450° C. depending on the exact carbon content of the alloy. At temperatures below this down to approximately 1300° C., smaller and smaller amounts of liquid are available. For WC-Co alloys of other Co percentages, the temperature shown for the various fields will go up or down, depending on composition. In particular lower Co contents raise these temperatures and higher cobalt contents lower these temperatures. Also lower cobalt contents narrow the WC+$\gamma$ field and higher Co contents widen the WC+$\gamma$ field.

The amount of liquid phase and the amount of WC solutioning have a great effect on all of the methods used to reduce porosity and voids in WC-Co alloys. This effect is due to the changes in capillary and other forces upon the physical situation of the material at the time that the porosity reduction process is applied.

One such process if commonly referred to as hot isostatic pressing (HIP). In this process, the parts are placed in a pressurizable furnace and pressurized to approximately 5000 psi cold and then elevated to the solidus temperature and above. At this temperature (above approximately 1250°–1350° C.) the pressure is increased to above 10,000 psi due to the thermal expansion of the gas used to initially pressurize the system at room temperature. The primary advantage of HIP processing is to virtually eliminate all porosity within the part as well as greatly minimize or eliminate larger randomly spaces slits, holes or fractures which may be present in the part provided that such holes, slits, or fractures are not open to the surface. During the HIP process, as the parts are heated above the solidus, the binder, e.g. cobalt, begins to become molten and the spaces between the hard particles begin to form capillary passageways which are open to the voids in the part. In the absence of pressure applied to the part, the capillary force created by these passageways would prevent any molten binder contained within the part from entering the voids in the part. These capillary forces pulling the molden binder away from voids in the part can range from 20 to 1500 psi depending on the size of the flaws present and the size of the capillaries between the grains. These factors depend on the specific WC-Co alloy under consideration and the specific temperature for which the calculations are done.

During the HIP process, extremely high pressures (10,000–15,000 psi) are applied to the parts at a temperature below the sodius and subsequently the temperature is raised to above the solidus. When the solidus temperature is reaches, some liquid phase is formed. However, the structure will still be rather rigid since all of the binder will not have melted (WC+$\gamma$+Liq field of FIG. 17). The high pressure applied to the parts at this time can then overcome the capillary forces and push the binder into any voids which might be present. This is well known in the art as "binder laking". This "binder laking" is one indication that some carbide users look for to be sure that a material was indeed HIP processed.

An example of such "binder laking" is shown in prior art FIG. 15 in which 16% WC-Co alloy part was subjected to the HIP process (1500× magnification). FIG. 15 (500× magnification) also shows a Hughes Tool Co. M.P.D. grade 168 after HIP processing. Large cobalt lakes are evident throughout the parts in both FIGS. 15 and 16. Although laking is preferable to porosity, it is much less desirable than a more homogeneous microstructure. Any discontinuity in a material including a "binder lake" will act as a stress riser when the material is subjected to stress and thus may shorten its useful life in a given application.

A further disadvantage of HIP processing is that due to the high temperatures and extremely high pressures used during the HIP processing, the previously known HIP equipment is extremely massive in construction and expensive to acquire. Also, HIP processing is a secondary process and requires that the parts be dewaxed and sintered in other equipment prior to being placed into the HIP equipment for that process to be effected.

Other methods wherein the sintering and hot isostatic processing may be carried out in one piece of equipment are disclosed in various prior art publications, some of which are discussed below.

Dr. Wolfgang Schedler, Reutte in Austrian Pat. No. 314,212 discusses a process for sintering alloys with a liquid phase in which, after reaching the eutectic temperature of the binder phase and a stage in the sintering shrinkage resulting in external sealing of still existing pores, the powder compacts are exposed to the isostatic pressure of an inert gas. He further states that "At about 50 vol % binder metal, a pressure of several bars is sufficient to achieve the effect of the invention," (hole closure) "while the final pressure should be about 200 bar or more below a binder metal of 10%.

In his example #1, a 25% cobalt material is heated to 1300 Degrees C. under vacuum and then subjected to 15 bar of argon pressure. The material is then further heated to 1320 Degrees C. Material prepared in this way performed 1½ times better in a stamping application than did material prepared in a similar manner but without pressurization.

Similar results were achieved in example #2 with a 9% cobalt WC alloy processed at 1400 Degress C. and 100 bar of argon pressure.

Example #3: A 5% cobalt material using 1420 Degree C. and 150 bar of pressure.

Example #7: 10% cobalt WC material using 1390 Degress C. at 180 bar of argon pressure.

Example #9: An 8% cobalt WC material at 1350 Degrees C. and 130 bar of argon pressure.

In all of the above cases, especially #1 and #9, the material was pressurized at a temperature where the material would have minimal liquid phase present (FIG. 17) and to a pressure that would have overcome capillary forces and yet the bulk material would have considerable resistance to the macro movement of the microstructure due to the high proportions of the solid phases. This would be indicated by the statement that these relatively large, 100 to 200 bar (greater than capillary forces), pressures are needed to effect hole closure. Thus the voids and or porosity may, to some degree, be filled by the eutectic liquid and give relatively the same performance improvements as HIP processed material would indicate. Material processed in such a manner would also be subject to the same disadvantages as HIP processed material, mainly cobalt laking, and the fact that equipment capable of high temperatures and up to 3000 psi (recommended for materials less than 10% Co) are expensive to acquire and utilize a great deal of the gas used to pressurize which must be continually cleaned in order not to effect the chemical balance of the alloys being processed.

A. Hara and N. Yoshida in a Japanese Pat. No. Sho 46-9528 discuss a method similar to the Schedler patent wherein powders for the manufacture of cemented carbide are molded and sintered, and pressure is then applied to the sintered product using high pressure gas after the shrinkage is almost complete.

In the example, they discuss a 7 wt% Co WC alloy which is heated to 1300 Degrees C. for 2 hours under vacuum and then pressurized to 1000 Kg/cm$^2$ (12000 psi). When pressurization is complete, the temperature is raised to 1400 Degrees C. and held for one hour to complete the processing. By treating such a material in this manner, pressurization again is carried out at a temperature where there may be minimal liquid phase available. Since however the pressure is very high, the small amount of eutectic liquid which may be present (if any) may be forced into any voids present by overcoming capillary action and thus effecting void closure. Again, this process may produce "cobalt lakes" which are preferable to voids but not as desireable as a more homogeneous structure. Also in this case, due to the very high pressures and the high temperatures used, the equipment necessary to accomplish this process is massive and expensive to acquire.

A somewhat different approach to densify carbide by pressurizing after sintering was taken by Johan Romp as described in U.S. Pat. No. 2,263,520. In this patent he describes a method of sintering carbide in a gaseous mixture of 85% $N_2$ and 15% $H_2$ or in 100% hydrogen for approximately 1 hour and then increasing the pressure by using a mixture of 85% $N_2$ and 15% $H_2$ to a pressure of 50 atm.

In his example I, he uses a 6% Co-WC alloy which he sintered at atmospheric pressure in an atmosphere of 85% $N_2$ and 15% $H_2$ at atmospheric pressure and 1450 Degrees C for 1 hour. At this point, the density was 14.5 gm/cu. Upon continued heating at 1450 Degrees C. and pressurizing to 50 atomospheres with the 85% $N_2$—15% $H_2$ mixture and subsequently cooled at the increased pressure, the density was increased to 14.85 gm/cu.

In example II he used a mixture of 79% WC, 15% TiC, and 6% Co sintered for 1 hour at atmospheric pressure in hydrogen at 1500 Degrees C. At this time, the density was 11.1 gm/cu. On further heating at 1500 Degrees C. in a gas mixture of 85% $N_2$ and 15% $H_2$ pressurized to 50 stmospheres and subsequently cooled under this high pressure the specific weight is increased to 11.45 gm/cu.

Using this procedure, as can be seen from the rather low densities observed after initial sintering, there is a great deal of porosity in the parts at the end of initial sintering. These pores, although sealed from the surface due to the liquid phase sintering at the high temperatures used, would be filled with the gaseous mixture used during sintering. This would especially be true for the mixture of 85% N2 and 15% H2. Thus, even though the porosity is substantially reduced by pressurization, the gaseous mixture trapped in the pores will remain since the pressure inside the void will remain nearly equal to the pressure outside the part as the outside pressure is increased and the voids begin to shink. This will necessarily result in an increase in density. However, the number of voids in the part will remain the same although they will be smaller. This is pointed out in the body of the patent in that he states "the increased pressure is preferably maintained even during cooling to avoid any risk that when the gaseous pressure is decreased while the body is still hot and slightly plastic, the effect of the invention may be influenced detrimentally". This indicates that if the pressure (50 atm) was removed before the material was solid and able to withstand internal stresses, the gas pressure in the remaining pores would cause the pores to again expand and decrease the density. Thus, by using this procedure, the size of the pores are reduced thereby increasing the density but the number of pores may not be substantially reduced; therefore, porosity is not totally eliminated. This residual porosity is detrimental to the performance of the material although not as detrimental as the original porosity level (and pore size) might be.

A further disadvantage of this process is that the current furnaces used for sintering carbide contain graphite in the hot zone and typically the parts themselves are placed on graphite trays for sintering. If such a furnace contained $H_2$ above about 1200 Degrees C., an equilibrium mixture of $H_2$ and $CH_4$ (formed by the reaction $2H_2+C$ solid$=CH_4$) would be formed and this mixture would by definition have a carburization potential of 1 and thus add carbon to the WC-Co alloy such that it would exhibit free carbon in the microstructure which would be detrimental to its performance.

In order to sinter carbide in a hydrogen containing atmosphere in the presence of graphite, the parts are typically buried in A1203 sand which forms a local balanced atmosphere around the parts and protects them from carburization. Using this procedure, however, in a pressurizable furnace would greatly reduce the capacity of the equipment due to the volume of A1203 and sand used.

A further disadvantage is that equipment capable of high temperatures and a pressure of 50 atom (750 psi) is massive in construction and expensive to acquire.

SUMMARY OF THE PRESENT INVENTION

The present invention provides a method for densifying and removing porosity in previously sintered carbide or other liquid phase sintered part which overcomes all of the disadvantages of the various proposed processes discussed above.

In brief, the method of the present invention comprises having previously sintered parts within a heatable pressurizable chamber. These parts may be either vacuum or hydrogen sintered and, similarly, may be cooled or not cooled following the sintering step. The parts are then heated to a temperature such that they are completely or nearly completely within the WC+liquid phase of the ternary phase diagram. In any case, such that considerble liquid is present and an equilibrium or nearly equilibrium amount of solutioning of the hard phase has occured, the sintered preform is in a relatively weak and mobile condition. The specific temperature will depend upon, of course, the specific material under question. Typically in the range of 1350 to 1600 Degrees C. With the parts in the appropriate regions of the phase diagram (WC+liq) the pressure vessel is pressurized with a gas, such as argon to a range with is below the pressure necessary to overcome the capillary force acting on the binder to prevent it from entering the voids but sufficient to physically move or collapse the structure inwardly. This pressure will vary from material to material but typically is in the range of 50 to 500 psi. The parts are maintained within the pressure vessel at the appropriate temperature for a relatively short time, typically 30 to 60 minutes. The parts may be heated first and then pressurized or pressurized first and then heated or simultaneously pressurized and heated under the following restrictions.

If the material has been previously hydrogen sintered, the parts should be heated under a vacuum to a temperature such that they are in or nearly in the WC+Liq region of their phase diagram before pressurization. This will help any hydrogen which may be trapped in the pores to dissolve in the liquid metal binder and escape before pressurization in order to trap any gas in such pores.

If the final pressure to be used is over that necessary to overcome the capillary forces in the material the parts should be heated in a vacuum to the appropriate temperature before pressurization. In such a case as the pressure increases, the proper closure will occur when a pressure is reached that will collapse the structure and yet not move significant amounts of binder. Thus further pressurization will not cause structure degradation such as "binder laking" since the voids are already filled with a homogeneous structure when the pressure might reach a level where it may be able to move the binder against the capillary forces.

Once processing is complete, the pressure may be relieved or left on during cooling without degrading the effect of the invention.

The preferred method of the invention is to dewax the parts (vacuum or hydrogen or wash gas), sinter the parts under vacuum (0.001 to 2 torr) and then effect pore closure by pressurization at the appropriate temperature for that material, as consecutive steps in a single piece of equipment as a single process.

Consequently, in the method of the present invention, the temperature and pressure used in such that the capillary force imposed on the molten binder (and dissolved hard phase) prevents the binder from entering the voids. The physical state of the material (yield strength) at the appropriate temperature for that material is such that the pressure applied externally to the part is sufficient to physically move or collapse the structure inwardly, thus filling the voids with a relatively homogeneous mixture of hard phase and binder and virtually eliminating "binder laking".

In practice, the method of the present invention substantially eliminates all porosity within the parts as well as closing larger randomly spaced holes in a manner superior to the previously known methods. The result of this is increased transverse rupture strength as compared to HIP and conventional sintering. This method is also more practical and less expensive to perform since the preferable pressure range is 50 to 500 psi and more preferably 50 to 300 psi and the equipment needed to perform such an operation is much less expensive to purchase and less expensive to operate then the equipment neded for the previously known processes. Also, since there may be an advantage to pressurizing slowly i.e. allow time for viscous flow of the structure into the voids thus equipment for fast pressurization is not necessary.

BRIEF DESCRIPTION OF THE DRAWINGS

A better understanding of the present invention will be had upon reference to the following detailed description when read in conjunction with the accompanying drawings, in which.

DETAILED DESCRIPTION OF A PREFERRED EMBODIMENT OF THE PRESENT INVENTION

The method of the present invention is designed to further densify parts which are liquid phase sintered such as cemented carbides, powdered metals, ceramics or the like.

Figure 17:
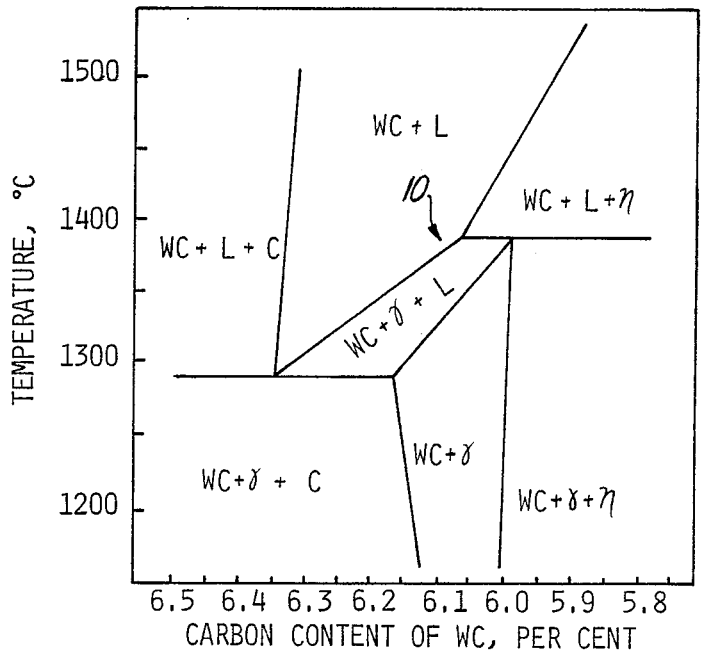
FIG. 17 is a Quasibinary WC-Co vertical section at 16% Co and varying carbon content.

In brief, in the method of the present invention in the case of WC-Co alloys, the sintered parts are contained in a heatable presurizable chamber. The parts are then heated to a temperature such that they reside in or nearly in the two phase (WC+liq) portion of the ternary diagram (FIG. 17). Most importantly, they are heated to a temperature such that all or nearly all of the binder plus dissolved hard phase (WC or other carbides) is in a liquid state and that an equilibrium or nearly equilibrium amount of the hard phase is dissolved in this liquid. (In the case of WC-Co alloys the Co may dissolve in excess of 50% of its own weight of WC). In this state the structure is in a state of minimum resistance to gross structural movement (low viscosity).

It should be noted that this temperature should be below that which might cause undesirable discontinuous grain growth. The parts should also have been sintered in a manner such that only gases which can be easily dissolve in the liquid phase are present in the voids, (such as $H_2$). Any such trapped gasses would preclude total closure of the voids or porosity. This may be accomplished by vacuum sintering or hydrogen sintering in a conventional manner. The heated parts are then pressurized with a gas such as argon to a pressure which is less than, and thus insufficient to overcome, the capillary force acting on the liquid binder so that the liquid binder is not forced into the voids in the part. This pressure, however, is to be greater than that necessary to physically move or flow the bulk material and thus sufficient to physically move or collapse the structure inwardly thus forcing a relatively homogeneous mixture of hard phase and binder into the voids. Although the precise pressure varies between different hard phase and binder compositions, the preferred range is between 50 to 500 psi. The parts are maintained at the appropriate temperature and pressure for a relatively short time, typically 15 to 60 minutes. The chamber is then cooled and depressurized or depressurized and cooled and the parts removed.

The capillary force of the liquid binder is calculated as follows:

Assume:

1. Surface tension ($\gamma$) of Co-WC solution at 1400 degrees C. in vacuum is $100\phi$ dynes/Cm$^2$.
2. Volume of binder phase (liquid) in WC+liq field of phase diagram is double that of the binder phase in the WC+$\gamma$ field.
3. Cubic grains.

$\Delta P$, i.e. force necessary to move Co-WC solution out of capillaries into voids, is calculated from the following equation:

$$\Delta P = 2\left(\frac{1}{r_1} - \frac{1}{r_2}\right)$$

Where $r_1$=radius of space between grains of WC $R_2$=void radius

However, $r_2$ is much greater than $r_1$ so that the above equation reduces to:

$$P = 2\ (1\emptyset\emptyset\emptyset \text{ dynes/Cm}^2)\left(\frac{1}{r_1}\right)$$

TABLE A

| Wt % Co | $r_1$ | Grain Size | P |
|---|---|---|---|
| 6% | .083 u | 2.5 micron | 240 bar |
| 6% | .333 " | 10 " | 60 bar |
| 10% | .133 " | 2.5 " | 144 bar |
| 10% | .555 " | 10 " | 36 bar |
| 16% | .222 " | 2.5 " | 90 bar |
| 16% | .95 " | 10 " | 22 bar |
| 25% | .30 " | 2.5 " | 65 bar |
| 25% | 1.25 " | 11 " | 16 bar |

Tests have shown that the previously sintered parts may be heated first (vacuum) and then pressurized, pressurized first and then heated or heated and pressurized simultaneously while remaining within the scope of the invention and without affecting the parts. It has also been found that the rate at which the material is pressurized and whether or not the material has been cooled or not after sintering has no effect on the parts. In the case of parts that have previously been sintered in hydrogen, there may be some advantage in first heating the parts in vacuum to allow any hydrogen trapped in the voids or porosity to dissolve in the binder and diffuse to the part surface and be removed prior to pressurizing.

In the preferred embodiment of the invention, green (as pressed) preforms are placed in an appropriate furnace such as described in U.S. Pat. No. 4,398,702 and the following procedure is followed.

1. The temperature slowly raised to a temperature above the vaporization point of the fugitive binder and below a temperature at which the hydrocarbons in the fugitive binder might crack (400 degrees C.) the hydrocarbon vapors are removed by vacuum pumping. Alternately a wash gas, such as hydrogen, argon or nitrogen, is used to convey the hydrocarbon vapors to a surface in the equipment where they may be condensed and appropriately removed.

2. Once the fugitive binder is completely removed the temperature is raised under vacuum (0.01–2.0 mm Hg) to the appropriate sintering temperature for the material in question (typically this would be temperature used for porosity and hole closure during pressurization).

This temperature would be held for the time period necessary to accomplish the liquid phase sintering of the material and to solution an equilibrium or nearly equilibrium amount of the hard phase in the binder. This would be typically 15 to 30 minutes.

3. The sintered parts would then be pressurized to the appropriate pressure with an inert gas, such as argon. This pressure would be typically in the range of 50 to 500 psi. The pressure and temperature would be held for approximately 15 to 30 minutes. Since these pressures (50-500 psi) are less than the pressure necessary to overcome capillary forces (see Table A above), binder laking is avoided. However, the pressurization must be sufficient to physically collapse to structure of the part.

When processing the parts in this manner the maximum pressure used need not be determined precisely since the proper void closure will occur (collapse of the structure into the voids) as the pressure is increased and thus if the pressure necessary to overcome capillary action is exceeded, the binder would not be able to fill the voids or porosity and form binder lakes because they would already be filed with a nearly homogeneous structure. If the vessel is pressurized first and then the parts heated the pressure obtained at the eutectic temperature must be below that necessary to overcome capillary action or the binder will fill the voids and binder lakes will result.

If pressurization is to be carried out after heating and or sintering and the temperature is not such that the parts are substantially in, i.e. in or nearly in, the two phase WC+liq phase field (see reference character 10 in FIG. 1) i.e. (just over the eutectic temperature and in the WC+$\gamma$+liq field of FIG. 17). Then even though there may be enough liquid phase for sintering, the parts may have a substantial yield strength and viscosity. In this case, the voids may not close at very low pressures due to structure collapse but rather in order to close the voids the pressure must be reached which will overcome capillary action such that closure will occur by binder movement thus producing binder laking.

Test results have established that the present invention effectively eliminates all porosity within the part as well as closing large holes or flaws by filling such holes with a relatively homogeneous hard phase and binder mixture. Since binder laking is eliminated, parts produced by the present method are superior to those produced by the prior art.

Also the present invention may be carried out in equipment which need be capable of only approximately 300 psi as opposed to prior art which needs equipment capable of 3000 to 10,000 psi and above therefore the necessary equipment is much less costly to acquire and operate.

The following examples indicate how the method of the present invention may be used to close a large flaw as well as decrease the porosity in the part.

EXAMPLE 1

Conventional vacuum sintering to show a large flaw.

1. Material—(90% WC—10% Co) medium gram size material. RA 88.6. Carbon content of WC 6.12%.
2. Place 15 gm of powder in 1" diameter mold.
3. Place parafin shaving—½" long, approximately 0.02" diameter—on powder to produce medium size flaw.
4. Add 15 gm of powder.
5. Place parafin shaving—½" long approximately 0.05" diameter—on powder to produce large flaw.
6. Add another 15 gm of powder.
7. Press powder mechanically at 30,000 psi.
8. Vacuum dewax bar at 420 Degrees C.
9. Sinter cycle—temperature 1415 Degrees C., pressure 100 microns Hg, time 90 minutes, then cool.

Figure 1:
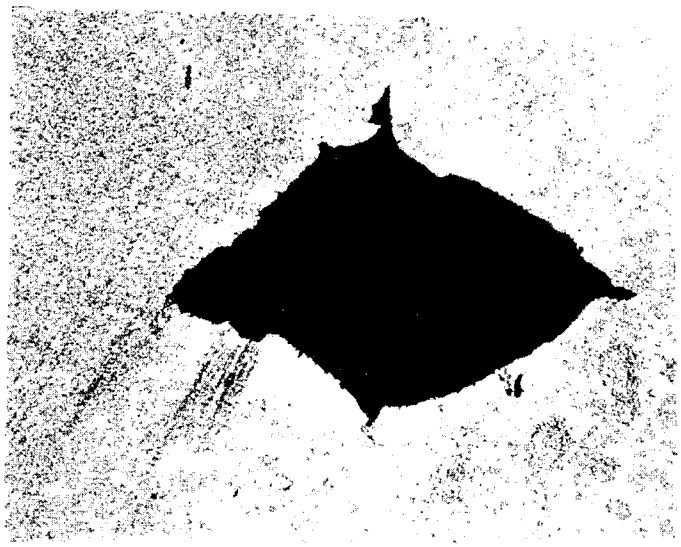
FIGS. 1–14 are all microphotographs of cross sections of parts illustrating the present invention.

The resulting cemented carbide sample from Example 1 has two flaws; one of which is shown in FIG. 1 at 784 magnification.

EXAMPLE 2

The parts produced by the steps described in Example 1 were then subjected to the following steps:

1. Maintained at 1415 Degrees C. following sintering.
2. Pressurized with argon gas to a pressure of 250 psi—17 bar.
3. Time 30 minutes.

Figure 2:
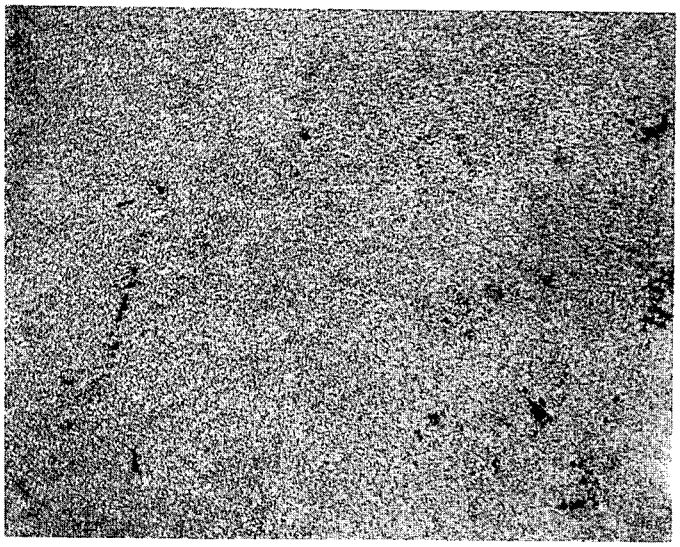
Figure 3:
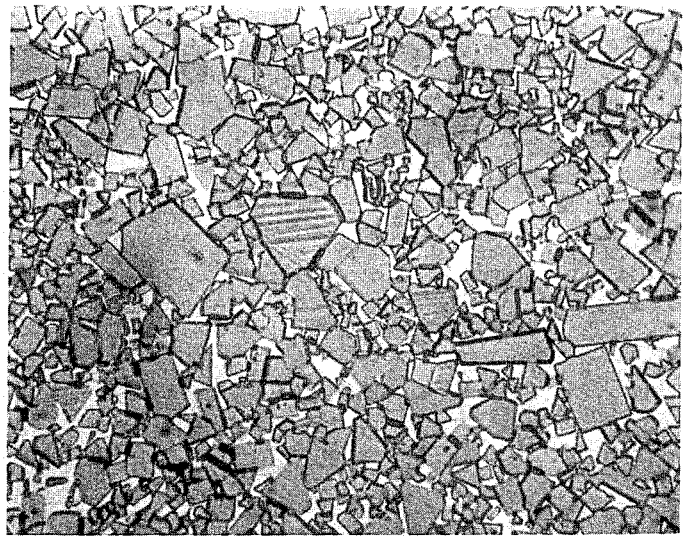

FIGS. 2 and 3 illustrate the complete closure of a large flaw at 754 and 1500× magnification, respectively, and with an absence of cobalt laking.

EXAMPLE 3

The parts produced by the steps described in Example 1 were then subjected to the following steps:

1. Parts maintained at 1415 degrees C. following sintering.
2. Pressurize with argon to 90 psi—6 bar.
3. Time 30 minutes.

Figure 4:
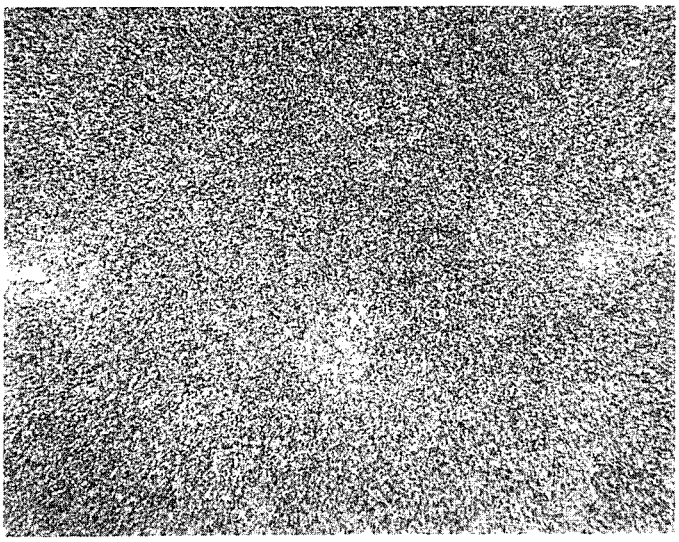
Figure 5:
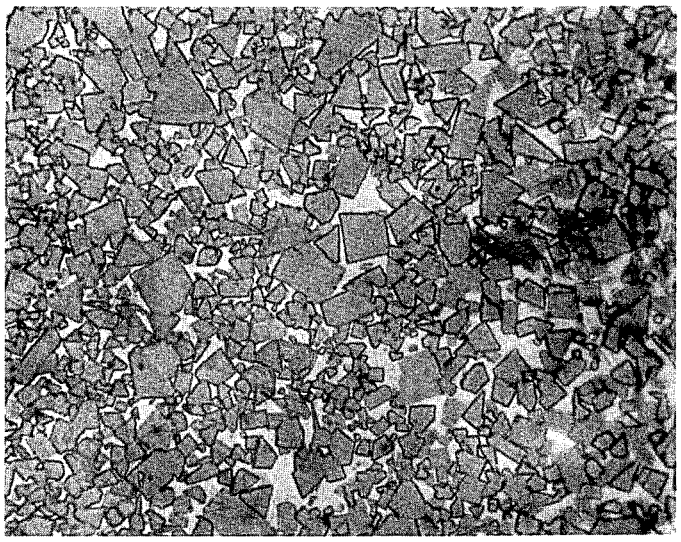
Figure 6:
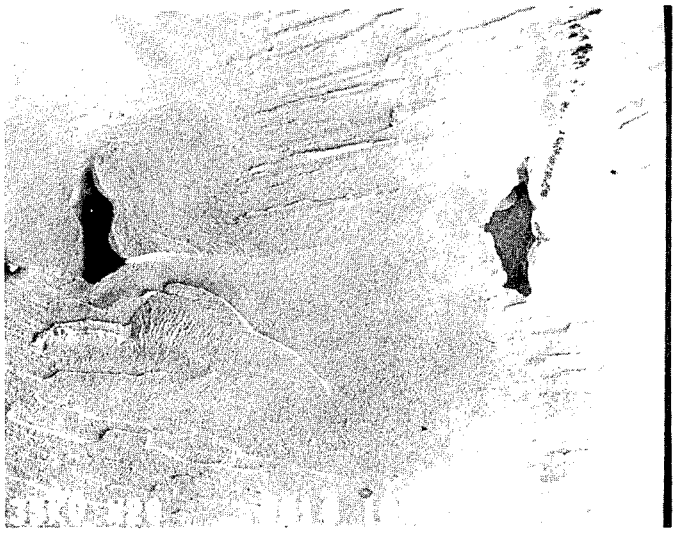

FIGS. 4 and 5 illustrate complete closure of the large flaw at 775× and 1500× magnification, respectively, with an absence of cobalt laking.

EXAMPLE 4

The parts from the lot of Example 1 were then subjected to the following steps:

1. Pressurized with argon to 160 psi—10 ar at room temperature.
2. Heated to 1415 Degrees C. whereupon the pressure rises to 250 psi—17 bar.
3. Maintained at temperature and pressure for 30 minutes.

Figure 7:
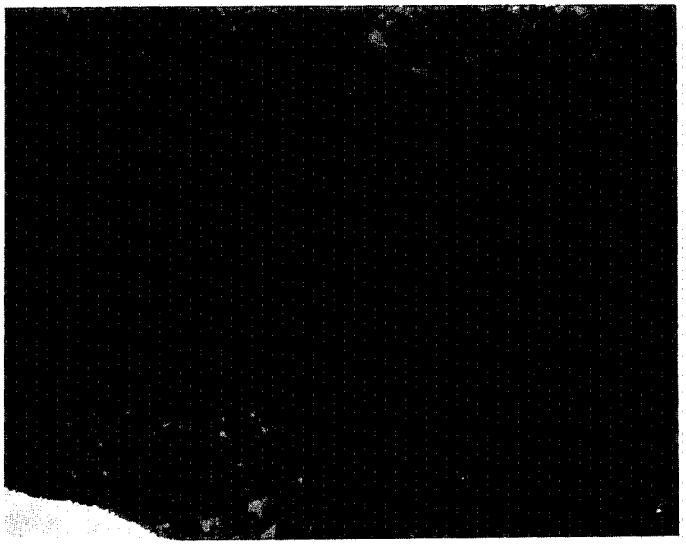
Figure 8:
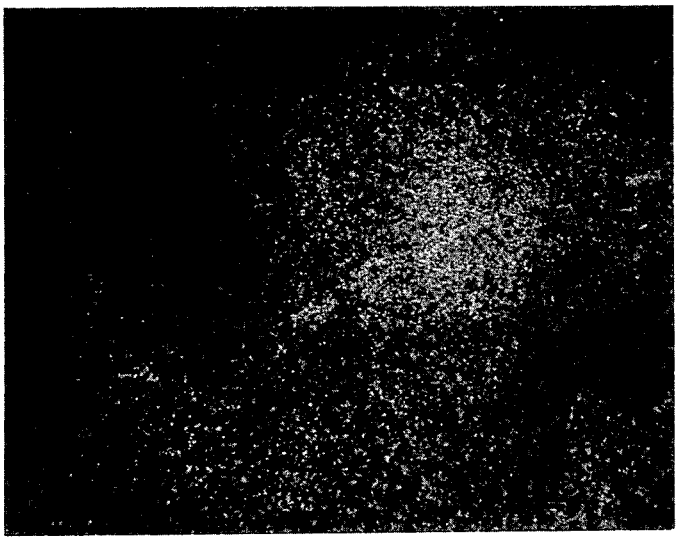
Figure 9:
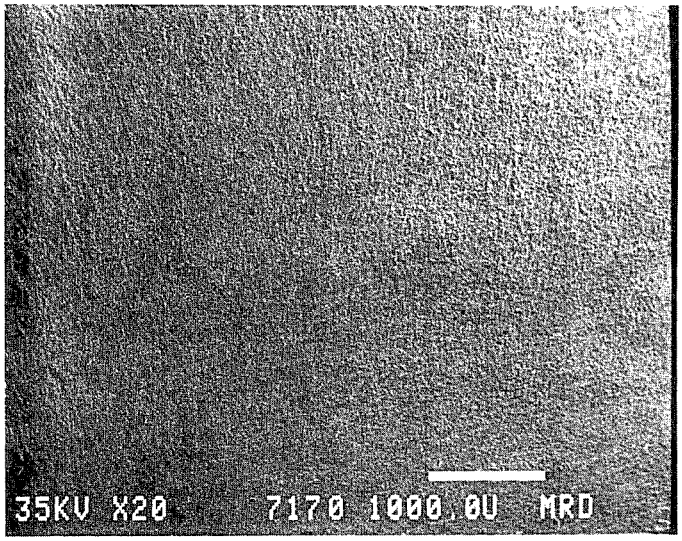
Figure 10:
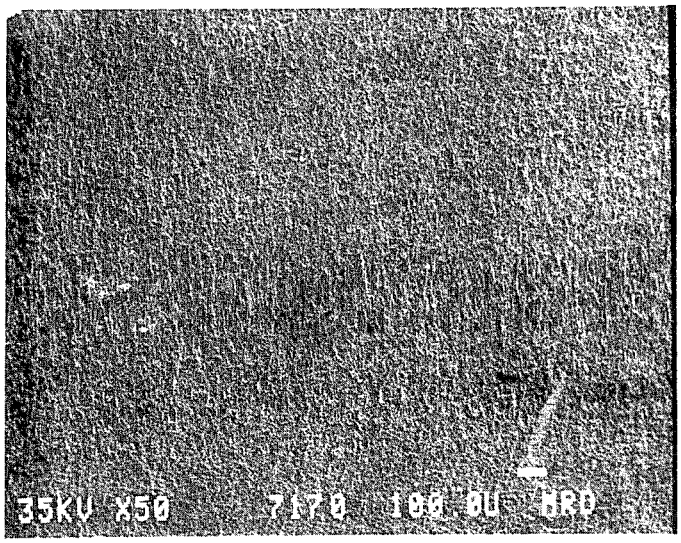

FIGS. 7 and 8 show complete closure of the large flaw at 1500× and 75× magnification, respectively, with the absence of cobalt laking.

EXAMPLE 5

The parts from the lot of Example 1 were treated the same as Example 2 except the parts were cooled to room temperature following sintering and reheated to 1415 Degrees C.

Figure 11:
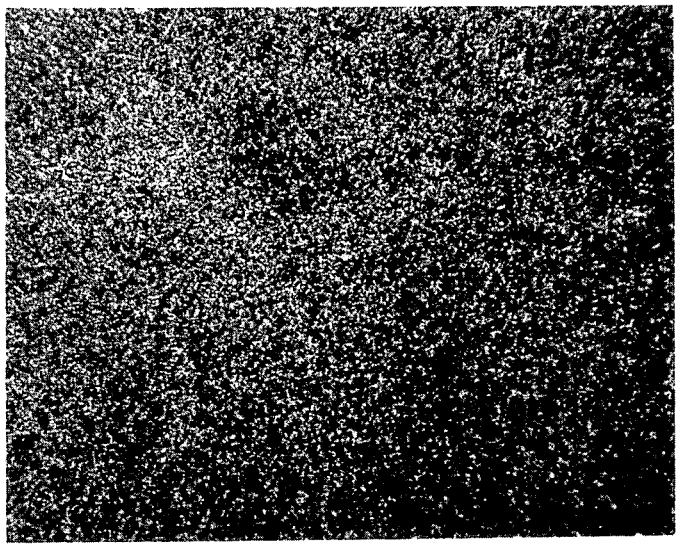
Figure 12:
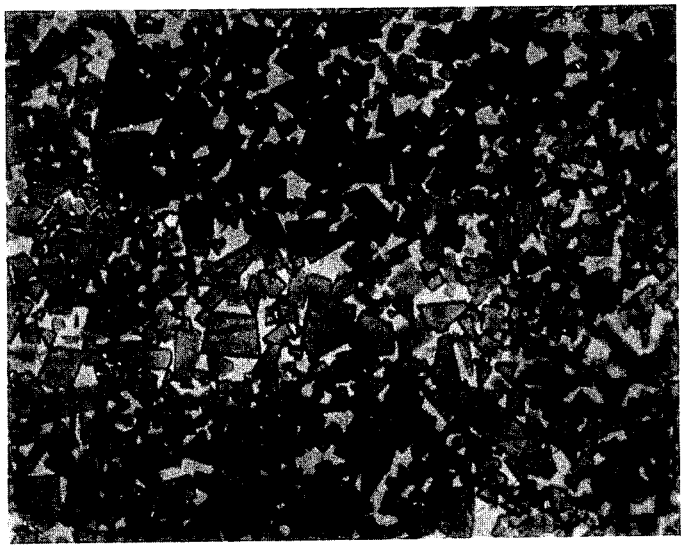

FIGS. 11 and 12 show complete closure of the large flaw at 75× and 1500× magnification, respectively.

EXAMPLE 6

The parts were processed in a manner identical to Example 1 except that a 16% cobalt WC alloy powder was used.

Material: 16% Co—WC alloy
Hardness: 86.5 RA
Carbon Content of WC—6.12%
The following steps were performed:

1. Heat parts to 1415 Degrees C.
2. Pressurize to 50 psi—3 bar.
3. Hold for 30 minutes.

Figure 13:
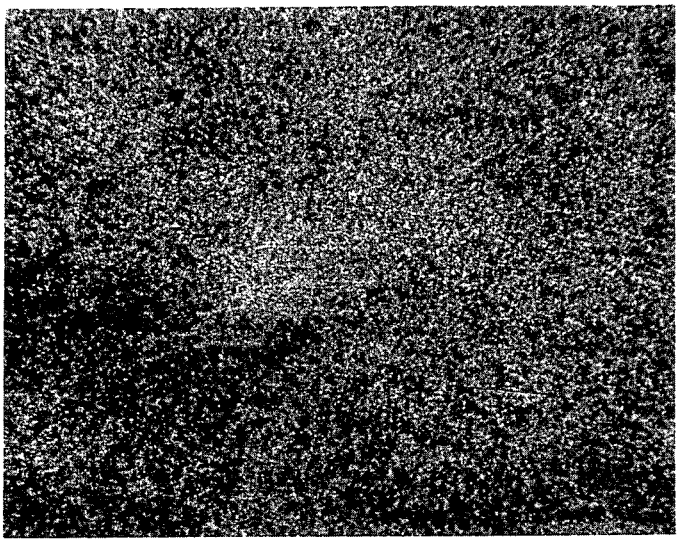
Figure 14:
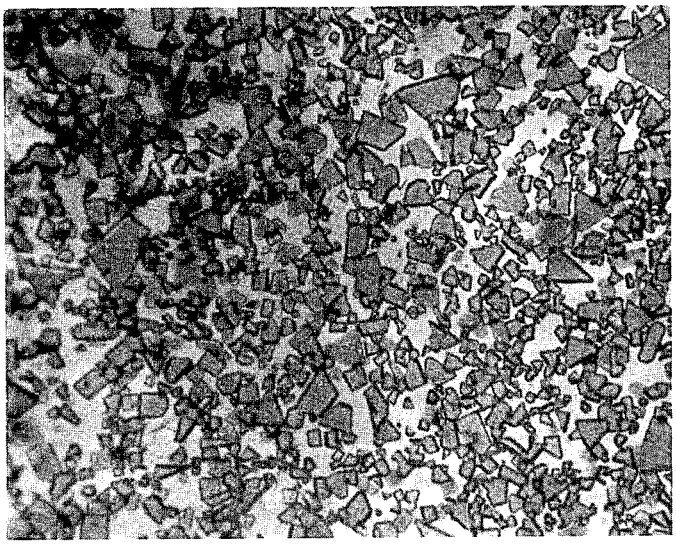
Figure 15:
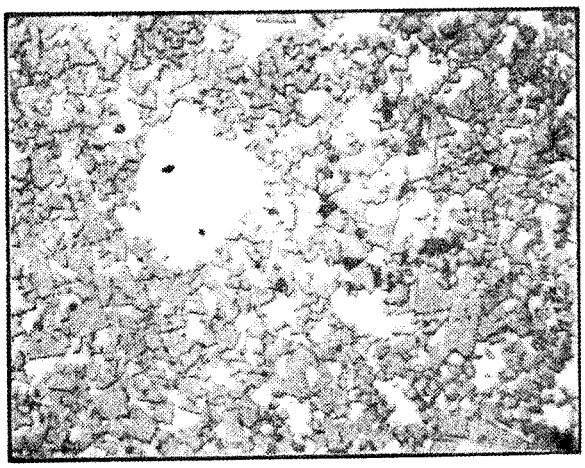
Fig - 15 Prior Art
FIGS. 15 and 16 are prior art microphotographs.
Figure 16:
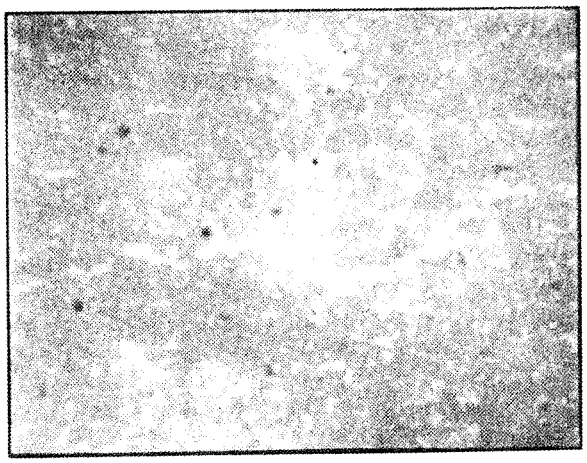
Fig - 16 Prior Art

FIGS. 13 and 14 illustrate complete closure of the flaws at 75× and 1500× magnification, respectively.

All of the above examples as can be seen from FIG. 17 were performed at a temperature and carbon content such that the material at the time of pressurization was in the two phase (WC+Liq) region of the phase diagram (reference character 10).

Test results have also shown that with 10% cobalt material complete closure of the flaws is not possible at 50 psi—3 bar and 1415 Degrees C. At that temperature, a pressure of 50 psi—3 bar is below the pressure necessary to overcome the capillary force imposed on the molten binder, but is also insufficient to physically move the material to collapse the voids to obtain void closure. Also tests have shown that at 300 psi—20 bar and 1400 Degrees C. that it is not possible to close voids in a 6% Co., 89% WC, 4.5% TiC, 0.5% TaC material whereas 300 psi at 1450 Degrees C. is fully effective in closing voids in such material. Thus at 1400 Degrees C. a higher pressure would be necessary to close voids in this material and at such a higher pressure the binder may be moved into the voids and cause binder laking. When the material was further heated to increase the amount of liquid phase and hard phase solutioning the voids were easily closed at 300 psi, a pressure below that necessary to overcome capillary action. This resulted in complete void closure in this material with no binder laking.

The following table illustrates test results showing that parts processed in accordance with the present invention achieve not only greater resistance to transrupture than sintered parts but also greater resistance to transrupture than parts that have undergone hot isostatic pressing. This greater resistance to transrupture is thought to result from the more homogenous microstructure ANALYTICAL TESTS PERFORMED ON KNOWN GRADES OF MATERIAL FOR COMPARISON VERIFICATION

| | TEST PIECES VACUUM SINTERED | | TEST PIECES VACUUM SINTERED THEN HOT ISOSTATICALLY PRESSED (10,000 PSI) | | TEST PIECES SINTERED AT ULTRA TEMP UNDER POSITIVE PRESSURE METHOD | |
|---|---|---|---|---|---|---|
| GRADE 9% COBALT BALANCED WC | 7 PIECES | 1 TEST CUBE | 7 PIECES | 1 TEST CUBE | 7 PIECES | 1 TEST CUBE |
| Density | 14.59 | | 14.58 | | 14.62 | |
| Hardness | 91.2 RA | | 91.2 RA | | 91.2 RA | |
| Trans-Rupture | 315,098 psi | | 345,517 psi | | 391,669 psi | |
| Microscopic | $A_1$ Porosity | | $A_0$ Porosity | | $A_0$ Porosity | |
| Material Structure | Normal | | Normal | | Normal | |
| Comments: | Standard Material | | Standard Material | | Standard Material | |
| GRADE 15% Cobalt BALANCE WC | 6 PIECES | 1 TEST CUBE | 6 PIECES | 1 TEST CUBE | 6 PIECES | 1 TEST CUBE |
| Density | 13.72 | | 14.00 | | 13.99 | |
| Hardness | 88.6 RA | | 88.9 RA | | 89.0 RA | |
| Trans-Rupture | 54,433 psi | | 82,299 psi | | 126,063 psi | |
| Microscopic | Macro porosity | | — | | — | |
| Material Structure | Normal | | Normal | | Normal | |
| Comments | Known intentional voids approx. .020" | | Voids all closed but had cobalt laking | | Voids all closed and had minimal cobalt laking | |

obtained by the present invention (i.e. minimal binder laking) than parts that have been HIP processed.

The densification and microstructural development of sintered parts obtainable by the present method is comparable or superior to the corresponding densification and microstructural development obtainable from the previously known art. The present invention, however, is advantageous over the prior art in that the present method employs comparitively much lower pressures than those needed in prior art, namely, one tenth of that used in the Rutter patent and less than one one hundredth of that used in HIP processing. Also there is no negative effect by pressurizing slowly. As such, the machinery and equipment necessary to practice the method of the present invention is much less massive and, therefore, much less expensive in construction than the corresponding machinery and equipment necessary for the process of prior art. Also the method precludes the possibility of trapping gases in the pores as would be the case in the Romp patent.

A still further advantage of the present invention is that the voids are filled with material having a homogeneous microstructure, thus, minimizing and even eliminating "binder laking".

Although many types of metallurgical furnaces can be used to practice the method of the present invention, preferably, the metallurgical furnace described in U.S. Pat. No. 4,398,702 entitled "Metallurgical Furnace", issued on Aug. 16, 1983 is used to practice the method of the present invention.

Although the preferred pressure range of the present invention is between 50 and 500 psi, for micro grain materials presures up to 1500 psi are necessary in order to overcome grain interlocking and still achieve the desired gross structural movement.

Having described my invention, however, many modifications thereto will become apparent to those skilled in the art to which it pertains without deviation from the spirit of the invention as defined by the scope of the appended claims.

I claim:

1. A method for densifying previously liquid phase sintered parts which may contain voids or porosity and constructed of cemented carbides, powdered metals, ceramics or the like comprising the steps of:

heating said parts in a vacuum to a temperature such that they are substantially in the two phase field of hard phase plus liquid and that an equilibrium or nearly equilibrium amount of hard phase has dissolved in the liquid phase, and applying a pressure in an amount below that which overcomes the capillary forces imposed on the molten binder in a direction away from the part voids and above the pressure necessary to physically collapse the part structure inwardly to said parts for a predetermined period of time while maintaining said parts above said temperature.

2. The method as defined in claim 1 wherein said pressure applying step comprises applying pressure to said parts in the range of 50 to 500 psi.

3. The method as defined in claim 1 wherein said pressure applying said step comprises applying pressure to said parts in the range of 50 to 300 psi.

4. The method as defined in claim 1 wherein said pressure applying step comprises the steps of placing said parts in a pressurizable chamber, and introducing a sufficient amount of gas to said chamber to create said pressure.

5. The method as defined in claim 4 wherein gas is argon.

6. The method as defined in claim 1 wherein said predetermined period of time is in the range of 5–500 minutes.

* * * * *